US005462377A

United States Patent [19]

Martinez, Jr. et al.

[11] Patent Number: 5,462,377

[45] Date of Patent: Oct. 31, 1995

[54] TOOTHBRUSH

[76] Inventors: Jose Martinez, Jr., 19302 Pine Glen Dr.; Michael P. Joyce, 17560 Braddock Rd., both of Fort Myers, Fla. 33912

[21] Appl. No.: 260,387

[22] Filed: Jun. 14, 1994

[51] Int. Cl.[6] ..... A46B 11/02

[52] U.S. Cl. ..... 401/185; 401/153; 401/184

[58] Field of Search ..... 401/184, 185, 401/153

[56] References Cited

U.S. PATENT DOCUMENTS

| | | | |
|---|---|---|---|
| 247,012 | 9/1881 | Chevallier | 401/185 |
| 1,358,523 | 11/1920 | Cook | 401/185 |
| 1,605,651 | 11/1926 | Doi | 401/185 X |
| 1,780,066 | 10/1930 | Christian | 401/153 |
| 3,261,367 | 7/1966 | Pickering | 401/153 |
| 3,501,243 | 3/1970 | Heiskell et al. | 401/184 X |
| 4,128,349 | 12/1978 | Del Bon | 401/151 |

FOREIGN PATENT DOCUMENTS

| | | | |
|---|---|---|---|
| 832499 | 7/1938 | France | 401/185 |
| 873571 | 3/1942 | France | 401/184 |
| 2000973 | 9/1969 | France | 401/185 |

*Primary Examiner*—Steven A. Bratlie

[57] ABSTRACT

A container loaded, pressure operated, toothpaste dispensing toothbrush having an elongated handle having a smooth diameter bore extending therethrough, a brush head having toothpaste outlets, and a removable, flexible, toothpaste application pump inserted into the smooth bore whereby exerting pressure on the pump forces toothpaste through the bore, through the brush outlets, and into brushing contact with the bristle tufts.

1 Claim, 2 Drawing Sheets

TOOTHBRUSH

BACKGROUND OF THE INVENTION

1. Field of the Invention

This invention relates generally to toothbrushes, and more particularly to a toothbrush having a handle adapted to transport toothpaste to the brush head and a bellows toothpaste container at the handle end which is squeezed accordion style to force the toothpaste through a hole in the handle shaft to the bristle outlet and through the bristles.

2. Discussion of the Prior Art

Various forms of fountain toothbrushes heretofore have been provided, but most have been difficult to operate insofar as refilling the toothbrush with toothpaste is concerned. One such device is disclosed in U.S. Pat. No. 1,780,066 to Christian which discloses a toothbrush with a bristle receiving head which has a passage provided therein at one end which opens below the bristles. The opposite end of the passage terminates in a conical portion. The capsule which is intended to receive the brush cleaning preparation is corrugated to facilitate the discharge of paste. The conical portion is fitted into the conical recess and the portion is fitted into the end portion of the tubular member.

U.S. Pat. No. 3,261,367 to Pickering discloses a cartridge-loaded pressure feed toothbrush containing a removable toothpaste cartridge within the handle within the handle which has a flexible accordion sidewall of suitable flexible material. The rear end of the cartridge is closed by a rear end wall. The forward end of the cartridge is closed by a rigid forward end wall of substantial thickness, which is formed with a tapered axial internally threaded socket. The rear end of the socket is closed by a relatively thin end wall which, when penetrated by the brush head nipple, breaks and provides an opening which affords communication between the interior of the cartridge and the brush head bore. The penetration is produced by screwing the brush head plug into the forward end of the handle until the shoulder engages the forward end of the handle.

U.S. Pat. No. 4,128,349 to Del Bon discloses a fountain brush having a bristle carrier and a set of bristles, a handle attached to the other end of the bristle carrier and a reservoir channel extending through the bristle from the reservoir into the bristle-bearing end of the carrier: the channel has at least one radial sidewall of the carrier. A slide valve member is guided sealingly in the interior of the channel. A closure member is adapted for hermetically closing the reservoir. A connecting rod extends substantially axially through the interior of the reservoir and connects the actuating device and the slide valve member to one another. An elastically deformable bellows is connected, hermetically sealingly, with the closing member, and with the inner wall of the handle, in actuated, as well as in unactuated position of the actuating device. The slide valve member obturates the orifice when in said unactuated position and, upon actuation by pressure on the closing member, is moved into the blind end of the channel past the orifice, clearing the latter.

Toothbrushes of this type have the disadvantage of demanding expensive working methods if only due to the manufacture of the bellows. Moreover the valves are very prone to blockage.

It is therefore an object of the present invention to provide an improved fountain brush of the initially described type, which can be manufactured extremely simply by mass production methods, while at the same time the filling process can be carried out substantially more easily than for the fountain toothbrush of the prior art. The fountain brush according to the invention may be used as a throw-away brush.

It is a further object of the invention to provide a fountain brush which applies metered amounts of toothpaste to the bristles.

It is yet a further object of the invention to provide a fountain brush which only requires a small amount of pressure on an external bellows to dispense a required amount of toothpaste. These and further objects, which will emerge from the text of the description that follows as depicted in the accompanying drawings.

DETAILED DESCRIPTION OF THE INVENTION

Figure 1:
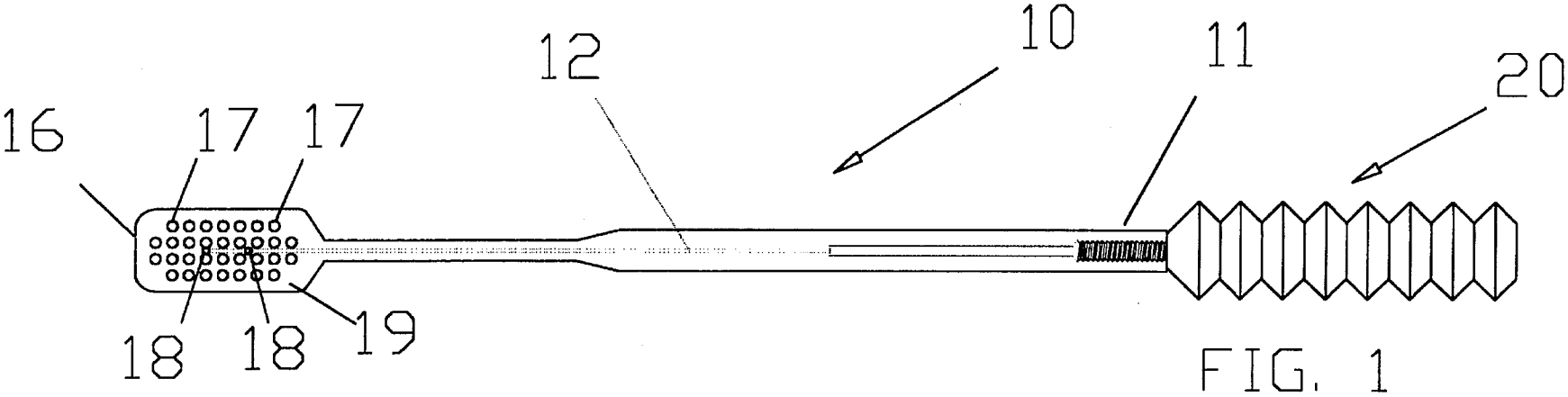
FIG. 1 is a top plan view of a paste brush in accordance with the invention.
Figure 2:
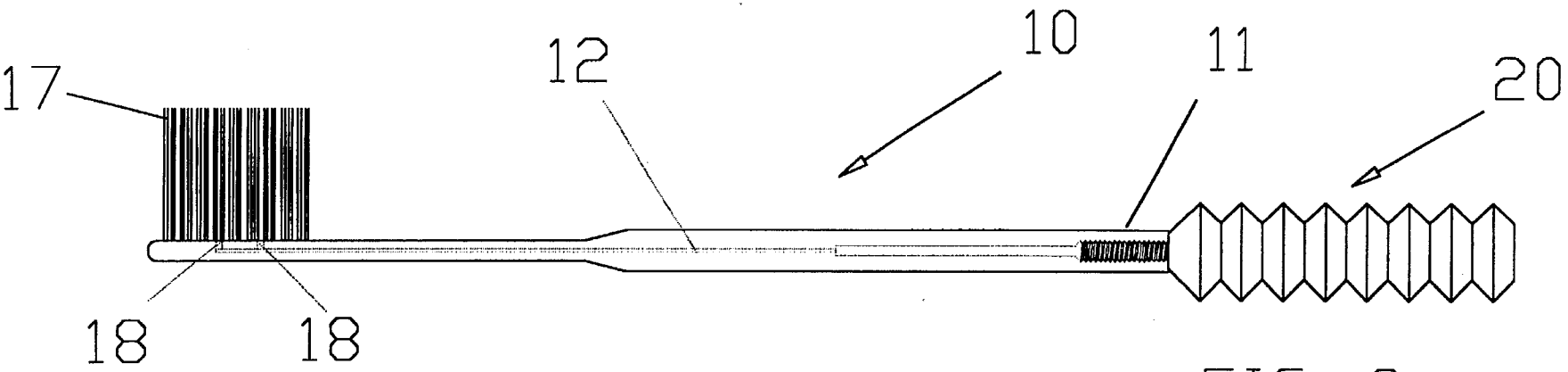
FIG. 2 is a side view of a brush head in accordance with the invention.
Figure 3:
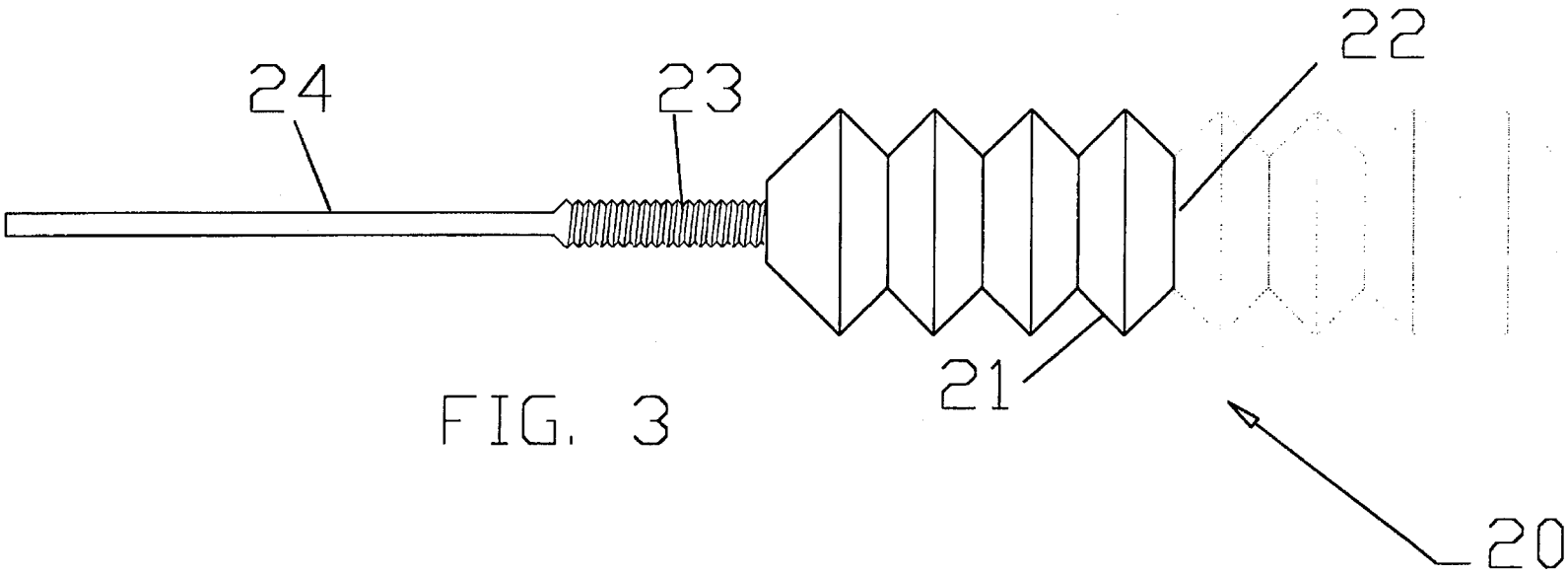
FIG. 3 is a plan view of a toothpaste application pump in accordance with the invention.
Figure 4:
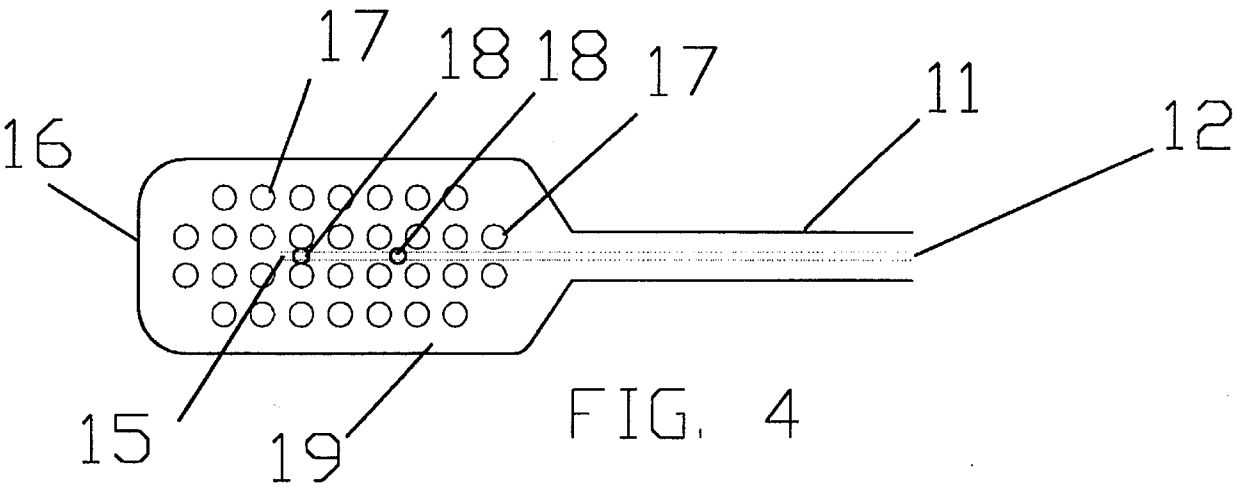
FIG. 4 is an enlarged view of a brush head in accordance with the invention.

Referring now more specifically to the drawings, the numeral 10 generally designates the paste brush of the instant invention. The paste brush 10 comprises an elongated handle 11, having a smooth uniform diameter bore 12 extending therethrough. The terminal end 13 of bore 12 is threaded at 14. The inner end 15 of bore 12 extends into the brush head 16. The brush head 16 includes a plurality of bristle tufts 17 supported therefrom and further includes outlets 18 opening into the inner end 15 and upwardly through the front side or surface 19 of the brush head 16 adjacent tufts 17. In the preferred embodiment, two outlets 18 are shown, however, additional outlets 18 may also be provided for larger size paste brushes 10.

The paste brush 10 is preferably formed of injection molded plastic or alternatively may be a resilient material. The bore 12 and outlets 18 may be molded in during production or drilled in a later manufacturing step. The bristles 17 of the paste brush 10 are embedded in the plastic body of the brush head 16 on surface 19 in a conventional manner. Paste brush 10 of this invention may be fabricated with a greater or lesser number of bristles 17 of varying sizes and dimensions and the brush head 16 may have more or fewer tufted bristles 17 in varying effective arrangements. The paste brush 10 is formed with curved and rounded edges so that no sharp angles are presented to the user's soft tissue which might cause damage.

Fastened to the terminal end 13 of paste brush 10 is a removable, toothpaste application pump 20, which in a preferred embodiment, has a flexible, accordion bellows shaped, sidewall 21 of suitable flexible material. The back end of the application pump 20 is closed by a back end wall 22. The forward end of the application pump 20 is formed with an external threaded portion 23 and an extended tube portion 24. Pump 20 as shown, is the travel size. For everyday home use, the application pump 20 is larger (dotted lines) and contains a larger amount of toothpaste. An application pump 20, filled with the appropriate toothpaste, is fastened to the terminal end 13 by inserting the extended tube portion 24 into smooth diameter bore 12, and turning the pump 20 until the threaded portions 14 and 23 are securely mated.

As the toothpaste application pump 20 is squeezed accordion style, the toothpaste is forced through extended tube portion 24, through the bore 12 of handle 11, through outlets 18 and ultimately throughout the bristle tufts 17. The length of application pump 20 will decrease after each application as the bellows sidewall 21 collapses with pressure until all of the toothpaste is depleted. In a preferred embodiment, the paste brush 20 of the invention will be packaged with four toothpaste application pumps 20 measuring 2½ inches in length and 1 inch in width at the widest point and ¾ inches at the at the smallest point. The four large pumps 20 are intended for home use. Included with the paste brush 10 will be one small pump 20 measuring 2 inches in length and ¾ inches width at the widest point and ½ inch at the smallest point. The smaller toothpaste application pump 20 will be for use in traveling. The travel toothpaste application pump 20 will also screw into the brush handle 11 as the larger toothpaste application pumps 20 do. This will allow a consumer to travel with one complete compact unit instead of a conventional toothbrush and a tube of toothpaste.

When all of the toothpaste application pumps 20 are empty, the paste brush 10 and the toothpaste application pumps 20 may be disposed of and the consumer would then purchase another complete set. The invention will also regulate the need for replacing toothbrushes that have worn bristles which are not effectively removing plaque and tartar. Each paste brush 10 unit should contain enough toothpaste for one month's usage based upon two usages per day.

The toothpaste provided with the paste brush 10 would be formulated to have sufficient viscosity to be easily pumped through the bore 12 but thick enough to remain in the paste brush 10 when not being pumped.

Although there have been shown and described preferred forms of the invention, it is to be understood that the invention is not necessarily confined thereto, and that any change or changes in the structure of and in the relative arrangements of components thereof are contemplated as being within the scope of the invention as defined by the claims appended hereto.

What is claimed is:

1. A container loaded, pressure operated, toothpaste dispensing toothbrush comprising:

an elongated handle having an inward end and a terminal end and a smooth diameter bore extending therethrough, said bore having an inner end and a terminal end, said terminal end having internal threads, formed in said bore, a brush head having a plurality of bristle tufts formed on said inward end of said handle, said brush head having toothpaste outlets communicating with said bore inner end for discharge of toothpaste to said bristle tufts, and an extended, removable, flexible, toothpaste application pump having an accordion bellows shaped sidewall of flexible and compressible material collapsible with pressure, an external threaded portion and an extended tube portion, said extended tube portion fitting within said terminal end of said bore and said external thread portion mating with and sealingly engaged with said internal threads, whereby exerting pressure on said application pump collapses said sidewall, forces toothpaste through said bore, through said outlets, and thus into brushing contact with said bristle tufts.

* * * * *